US005092292A

United States Patent [19]

Iguchi et al.

[11] Patent Number: 5,092,292

[45] Date of Patent: Mar. 3, 1992

[54] LUBRICATING APPARATUS OF MOTORCYCLE ENGINE

[75] Inventors: Hiroaki Iguchi, Shizuoka; Eiichi Nakamura, Kosai, both of Japan

[73] Assignee: Suzuki Jidosha Kogyo Kabushiki Kaisha, Shizuoka, Japan

[21] Appl. No.: 472,929

[22] Filed: Jan. 31, 1990

[30] Foreign Application Priority Data

Jan. 31, 1989 [JP] Japan ..... 1-21159
Jan. 31, 1989 [JP] Japan ..... 1-21160

[51] Int. Cl.[5] ..... F01M 1/00
[52] U.S. Cl. ..... 123/196 R; 123/196 AB
[58] Field of Search ..... 123/41.34, 41.35, 41.39, 123/196 AB, 196 R

[56] References Cited

U.S. PATENT DOCUMENTS

| | | | |
|---|---|---|---|
| 3,709,109 | 1/1973 | Howe | 123/41.35 |
| 4,667,630 | 5/1987 | Sasaki | 123/41.35 |
| 4,742,803 | 5/1988 | Chiles et al. | 123/41.39 |
| 4,854,276 | 8/1989 | Elsbett et al. | 123/196 AB |
| 4,869,211 | 9/1989 | Herberle | 123/41.35 |
| 4,901,679 | 2/1990 | Hodgkins | 123/41.35 |

*Primary Examiner*—E. Rollins Cross
*Assistant Examiner*—Erick Solis
*Attorney, Agent, or Firm*—Schwartz & Weinrieb

[57] ABSTRACT

An engine of a motorcycle is provided with a lubricating apparatus and a crank case within which is mounted a crank shaft having one end extending outwardly from a side wall of the crank case, and a cam sprocket drive gear is mounted upon the crank shaft. A cam chain chamber within which a chain is disposed in a loop is formed upon one side of a cylinder block including a cylinder and a piston and a cylinder head disposed above the cam sprocket drive gear. An oil passage hole is formed within a mating face of the crank case to be mated with the side cover, and an oil passage tube is inserted into the oil passage hole. The oil passage tube has a front end provided with at least one oil jetting hole and extends through an inner space defined by means of the looped cam chain and extends further so as to penetrate the side wall of the crank case so that the oil jetting hole is directed toward a lower surface of the piston when the latter is disposed at a lower dead position from the lower side of the piston so as to jet oil guided through an oil passage formed within mating faces defined between the crank case and the side cover towards the lower surface of the piston. The rear portion of the oil passage tube is provided with an engaging piece so as to firmly secure the tube to the crank case.

9 Claims, 6 Drawing Sheets

LUBRICATING APPARATUS OF MOTORCYCLE ENGINE

FIELD OF THE INVENTION

This invention relates to lubricating apparatus for a motorcycle engine, and more particularly to lubricating apparatus for cooling a piston of an overhead cam type four-cycle engine.

BACKGROUND OF THE INVENTION

A four-cycle engine mounted upon a motorcycle is usually of the overhead cam type and is provided with a cam chamber within which a cam chain for driving the cam is accommodated and which is usually integrally formed within and with a cylinder block and a cylinder head.

Lubrication for a variable valve mechanism, a large diametered portion of a control rod of the engine cylinder, a bearing portion of the crank shaft, and the like of the engine of the type described above is performed by means of lubricating oil pumped from an oil pan disposed within a lower bottom portion of a crank case by means of an oil pump through an oil passage formed so as to penetrate a thickened portion of the crank case and an oil passage composed of a recessed groove formed within a mating face of the crank case to be mated with a side cover.

Lubrication inclusive of the cooling of the piston is further performed for achieving the lubrication between the cylinder and the piston and between a small diametered portion of the control rod and a piston pin by properly supplying oil to the lower surface of the piston by suitable oil jetting means.

In accordance with conventional technology, the oil jetting means is, in one arrangement, disposed directly below the lower end of the piston when the same is positioned at a lower dead position and is embedded within the upper end portion of the side wall of the crank case so that the front end of the jetting means is directed toward the inner surface of the piston through means of a gap defined between the lower end opening of the cylinder and the outer peripheral side surface of the crank web. The oil is supplied to an oil passage formed so as to penetrate a thickened portion of the side wall of the crank case.

In accordance with another arrangement, the oil jetting means is itself disposed at the same position as described with respect to the above arrangement, but in this arrangement, the oil is supplied to the jetting means through means of an oil passage formed within the outer periphery of a bearing of the crank shaft.

In both of these arrangements, however, since the oil jetting means are embedded within oblique holes or bores formed within the upper end portion of the side wall of the crank case, a drilling working operation is required in order to form the inclined hole, which requires a drilling operation which is different and independent from the other operations, resulting in an increase of the usage of additional tools, of the manufacturing processes and, hence, of the manufacturing cost. Furthermore, in a certain case, it may be troublesome to form the oil passage within the lower portion of the crank case so as to avoid any interference with the location of the other members or elements disposed upon the side surface of the crank case.

In accordance with another method for forming the oil passage as a passageway, a recessed groove within the mating faces of a side cover mounted upon the side surface of the crank case, for example, a clutch cover, and the crank case. In accordance with this structure, an oil connection passage is provided for the oil jetting means so as to thereby simplify the entire structure.

However, in the case where the cam chain chamber is disposed between the clutch cover and the side wall of the crank case, it is difficult to provide the oil passages so as to bypass these portions, and thus the simplification of the structure of the oil passages even in accordance with the method described above cannot readily be realized.

OBJECT OF THE INVENTION

An object of the invention is to substantially eliminate the defects or drawbacks encountered with the conventional technology described above and to provide a lubricating apparatus for a motorcycle engine which is particularly provided with a cam chain chamber and which is capable of supplying oil to the lower surface of the piston of the engine unit which is located at a lower dead position without forming a complicated oil passage means, thus improving the workability of the lubricating apparatus with reduced manufacturing costs.

SUMMARY OF THE INVENTION

The foregoing and other objects can be achieved according to this invention by providing a lubricating apparatus for a motorcycle engine in which there is arranged a crank case within which is mounted a crank shaft having one end extending outwardly from a side wall of the crank case, the extending one end being covered by means of a side cover, a cam sprocket drive gear is mounted upon the crank shaft, and a cam chain chamber within which a chain is disposed in the form of a loop between the cam drive sprocket gear and a cam driven sprocket gear is formed upon one side of a cylinder block including a cylinder and a piston and a cylinder head disposed above the cam sprocket drive gear, and characterized within that a passage hole is formed in a mating face of the crank case to be mated with the side cover and an oil passage tube is inserted into the passage hole, the oil passage tube having a front end provided with at least one oil jetting hole extending through an inner space defined by means of the looped cam chain and extending further so as to penetrate the side wall of the crank case so that the oil jetting hole directs a spray of oil toward a lower surface of the piston when the latter is disposed at a lower dead position from a position disposed beneath the lower side of the piston so as to jet oil guided through means of the oil passage formed between the mating faces defined between the crank case and the side cover towards the lower surface of the piston.

In a preferred embodiment, the oil passage tube is provided with a rear end having a portion bent outwardly normal to the longitudinal axis of the oil passage tube and the mating face of the crank case is provided with an engaging groove which is engaged by the bent portion of the oil passage tube.

According to the structure described above, the oil can be directly supplied towards the lower surface of the piston when the same is disposed at the lower dead position by discharging the oil through means of the jetting hole formed within the front end of the oil passage tube inserted within the engine unit through the side wall of the crank case from the oil passage formed within the mating faces defined between the crank case and the side cover. This structure can eliminate the location of the oil passage at the lower portion of the crank case or within the thickened portion of the side wall of the crank case. The oil passage tube can be inserted into a hole formed normal to the mating face at a time of performing the necessary drilling operations for the screw holes workability of the lubrication apparatus, that is, the engine unit. The oil passage tube can be easily removed simply by removing the side cover, resulting in high maintenance performance characteristics.

BRIEF DESCRIPTION OF THE DRAWINGS

Various other objects, features, and attendant advantages of the present invention will become better understood from the following detailed description, when considered in connection with the accompanying drawings, in which like reference characteristics designate like components throughout the several views, and wherein.

DESCRIPTION OF THE PREFERRED EMBODIMENTS

In advance of the description of the preferred embodiment of this invention, conventional technology in this art field will first be described with reference to FIGS. 9 and 10 for a better understanding of this invention.

Figure 9:
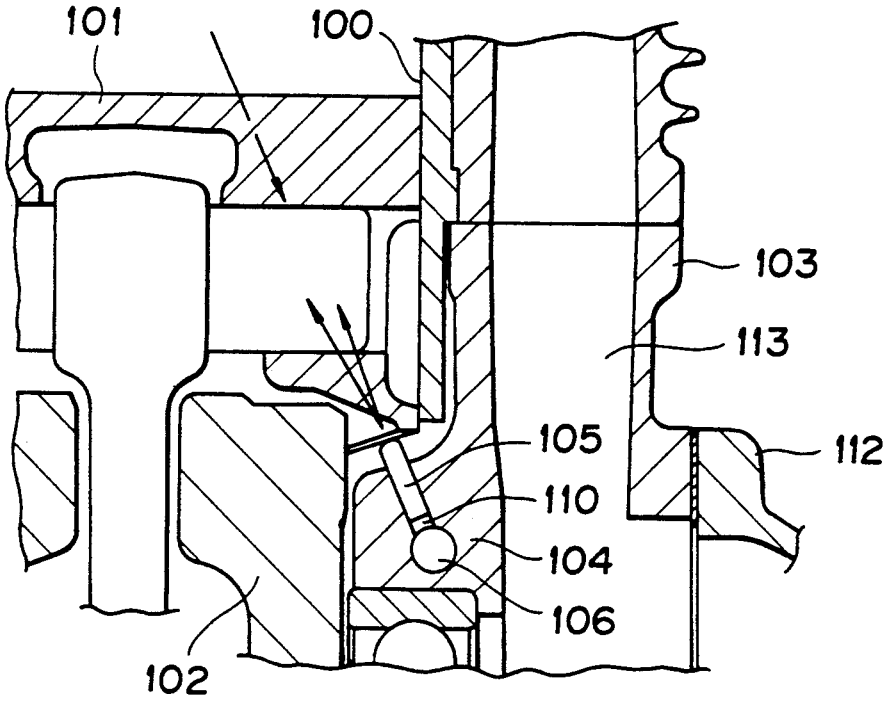
FIG. 9 PRIOR ART
FIGS. 9 and 10 are partial elevational sections of conventional piston cooling devices for a motorcycle engine.

FIG. 9 is an elevational section of a conventional piston cooling device of an engine unit of a motorcycle, and an oil jetting means of this piston cooling device is disposed directly below the lower end of the piston 101 which is illustrated as being disposed at a lower dead position and is embedded within the upper end portion of the side wall 104 of the crank case 103 so that the front end of the jetting means 105 is directed toward the inner surface of the piston through means of a gap defined between the lower end opening of the cylinder 100 and the outer peripheral side surface of a crank web 102. The oil is supplied to an oil passage 106 which is formed so as to penetrate the thickened portion of the side wall of the crank case.

Figure 10:
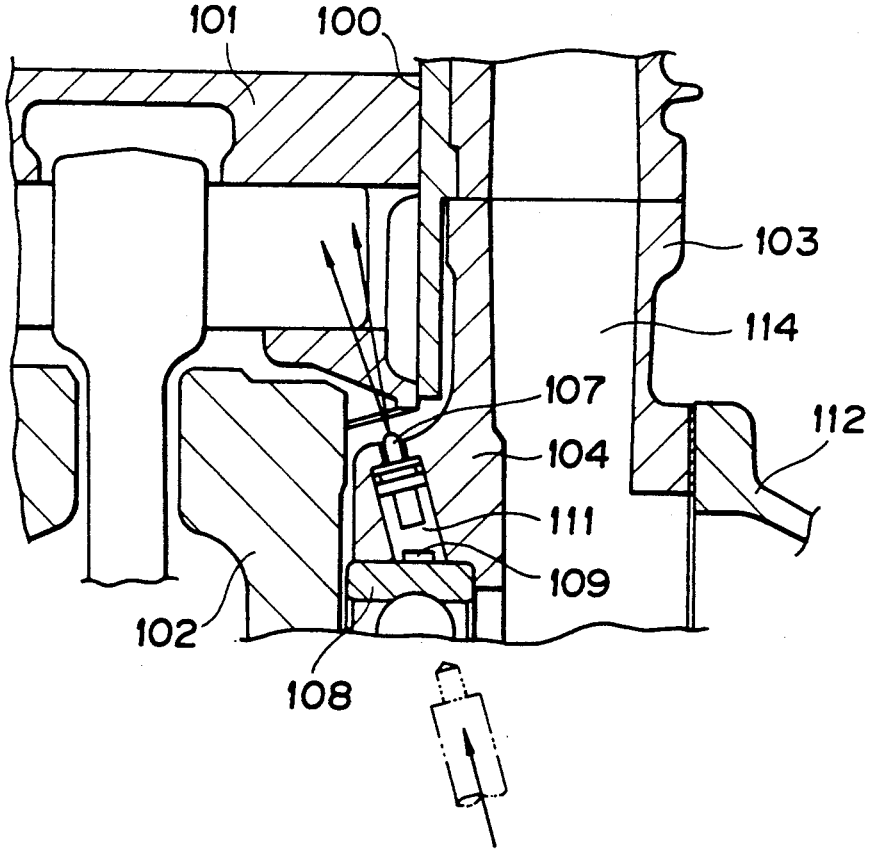
FIG. 10 PRIOR ART

FIG. 10 shows another arrangement of a conventional piston cooling device, the oil jetting means 107 of this example being disposed at substantially the same position as that described with respect to the above arrangement of the jetting means 105 of FIG. 9, but in this arrangement, the oil is supplied to the jetting means 107 through means of an oil passage 109 formed within the outer peripheral of a bearing 108 of the crank shaft.

In these arrangements of FIGS. 9 and 10, the oil jetting means 105 and 107 are embedded within an oblique bore 110 or 111 formed within the upper end portion of the side wall of the crank case by means of the drilling operation, which must be done in an inclined manner. This involves troublesome working conditions and defects as described before.

In accordance with another method for forming the oil passage except for the drilling operation, it is effective to form, as a passageway, by means of a mating operation, a recessed groove within the mating faces defined between a side cover mounted upon the side surface of the crank case, for example, a clutch cover 112, and the crank case 103. In accordance with this structure, an oil connection passage is provided for the oil jetting means so as to thereby simplify the entire structure. However, this method also involves a defect in a case where the cam chain chamber 113 or 114 is disposed between the clutch cover and the side wall of the crank case for the reason described hereinbefore. Accordingly, in the conventional piston cooling devices of the type shown in FIG. 9 or 10, it is difficult to provide an improved lubrication means for an engine unit of a motorcycle which has a simplified structure and which can attain the improved function and effect.

This invention was therefore conceived so as to substantially eliminate the defects or drawbacks encountered in connection with the prior art described above and will be described in detail hereunder with reference to FIGS. 1 to 8.

Figure 1:
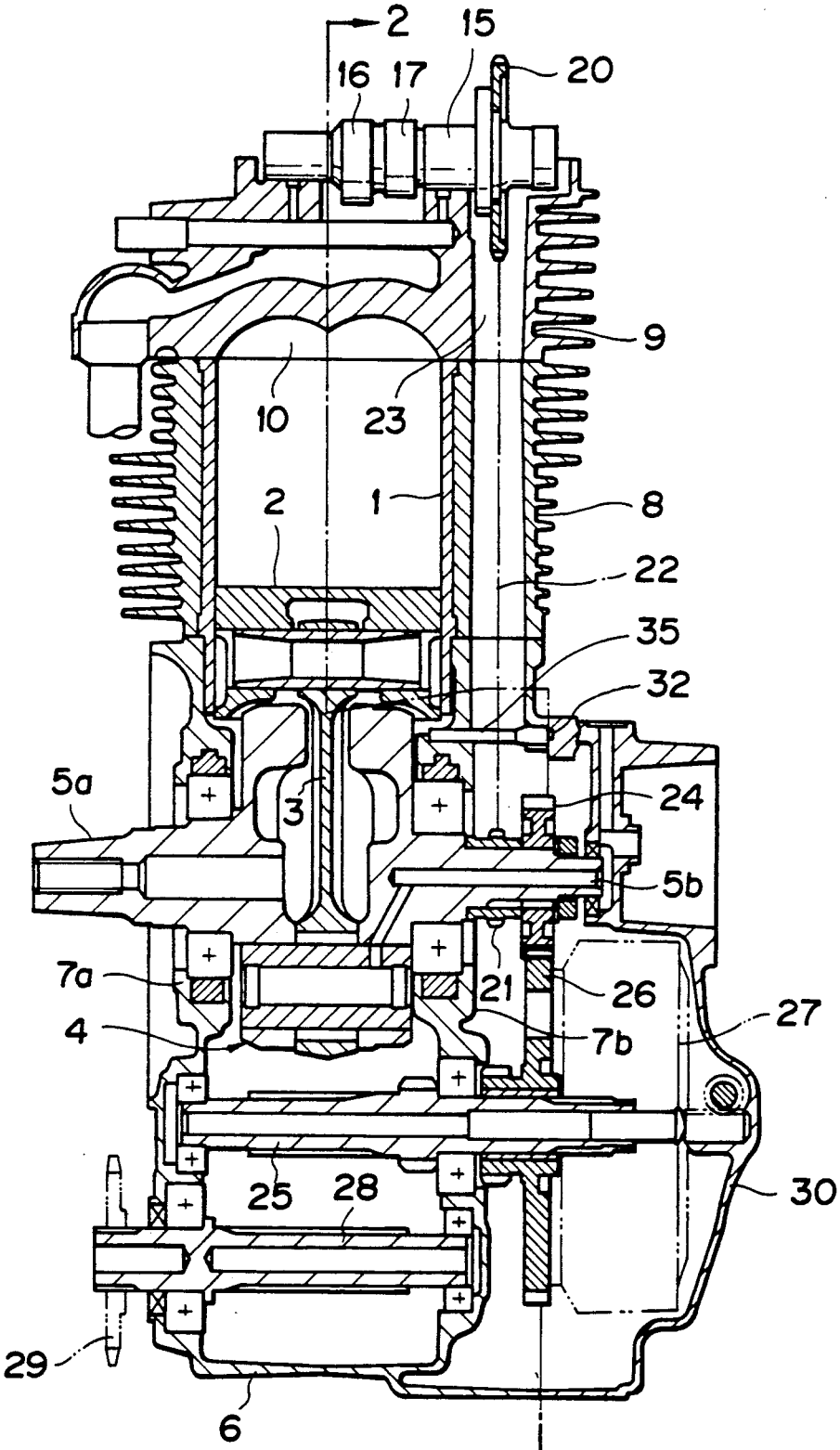
FIG. 1 is an elevational section of a single cylinder four-cycle engine of a motorcycle.
Figure 2:
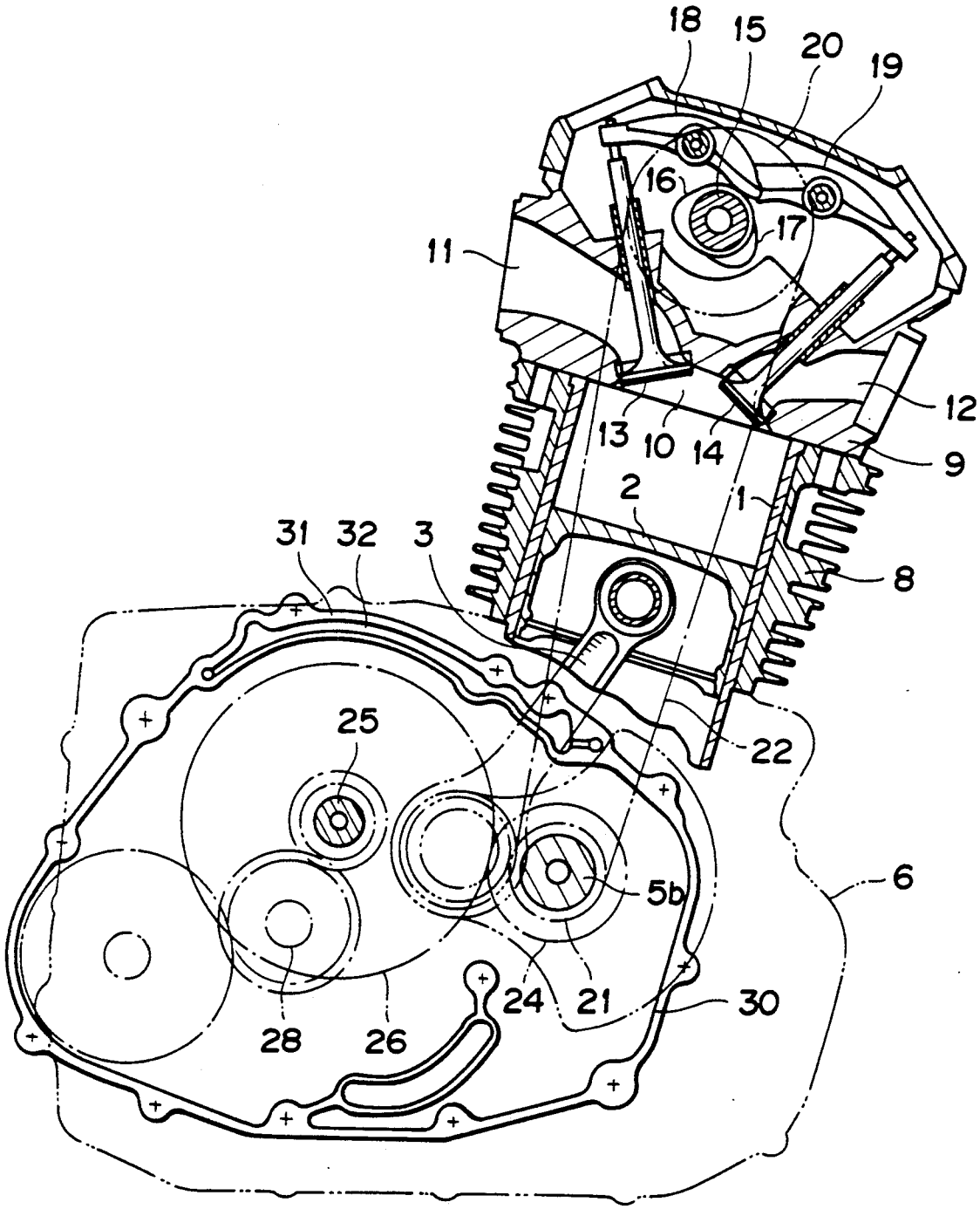
FIG. 2 is an elevational section taken along the line 2—2 shown in FIG. 1.

FIG. 1 is an elevational front section of a single cylinder four-cycle engine provided with a lubrication apparatus according to this invention and FIG. 2 is a sectional view taken along the line 2—2 in FIG. 1.

Referring to FIGS. 1 and 2, a piston 2 accommodated within a cylinder 1 is coupled with a crank 4 through means of a control rod 3 and is slidably displaced vertically in the illustrated arrangement in synchronism with the rotation of the crank 4. The crank 4 is supported upon side walls *7a* and *7b* of a crank case 6 by means of crank shafts 5a and 5b, which extend outwardly from the side walls *7a* and *7b* of the crank case 6, respectively.

A cylinder head 9 is mounted upon a cylinder block 8 within which the cylinder 1 is formed, and the cylinder head 9 is provided with a combustion chamber 10 at the lower portion thereof to which an intake passage 11 and an exhaust passage 12 are connected so as to be opened or closed by means of the operations of an intake valve 13 and an exhaust valve 14. The opening and closing operations of both the valves 13 and 14 are controlled by means of the rotations of an intake cam 16 and an exhaust cam 17 journaled within the upper surface of the cylinder head 9 by means of the operations of rocker arms 18 and 19.

The cam shaft 15 has one end upon which there is journaled a cam driven sprocket gear 20 which is driven through means of a cam chain 22 disposed in an annular loop between the cam driven sprocket gear 20 and a cam drive sprocket gear 21. The cam chain 22 is disposed within a cam chain chamber 23 formed within the cylinder block 8 and the cylinder head 9.

A primary drive gear 24 is mounted upon the crank shaft 5b so as to be engageable with a primary driven gear 26 mounted upon a counter shaft 25. The counter shaft 25 is rotated through means of an open-close clutch 27 and the rotation of the counter shaft 25 is transmitted to a drive shaft 28 through means of a transmission gear mechanism, not shown. Reference numeral 29 designates a drive sprocket gear for the output mounted upon the drive shaft 28.

The crank shaft 5b, the cam drive sprocket gear 21, the primary drive gear 24, the primary driven gear 26, the open-close clutch 27, and the counter shaft 25 are substantially covered by means of the clutch cover 30 mounted upon one side of the crank case 6.

Figure 3:
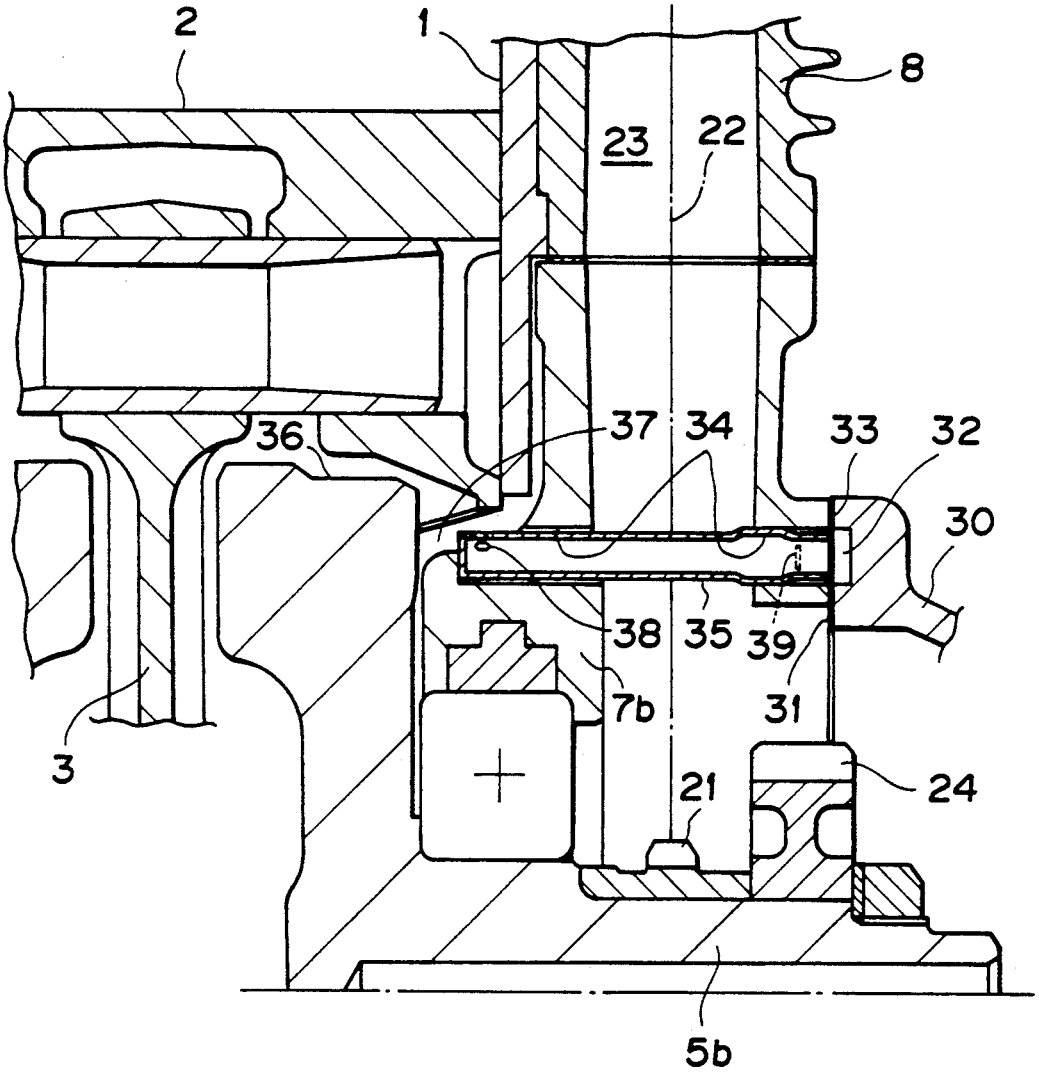
FIG. 3 is an enlarged sectional view showing mating portions of the crank case and the side cover of the engine shown in FIG. 1.
Figure 4:
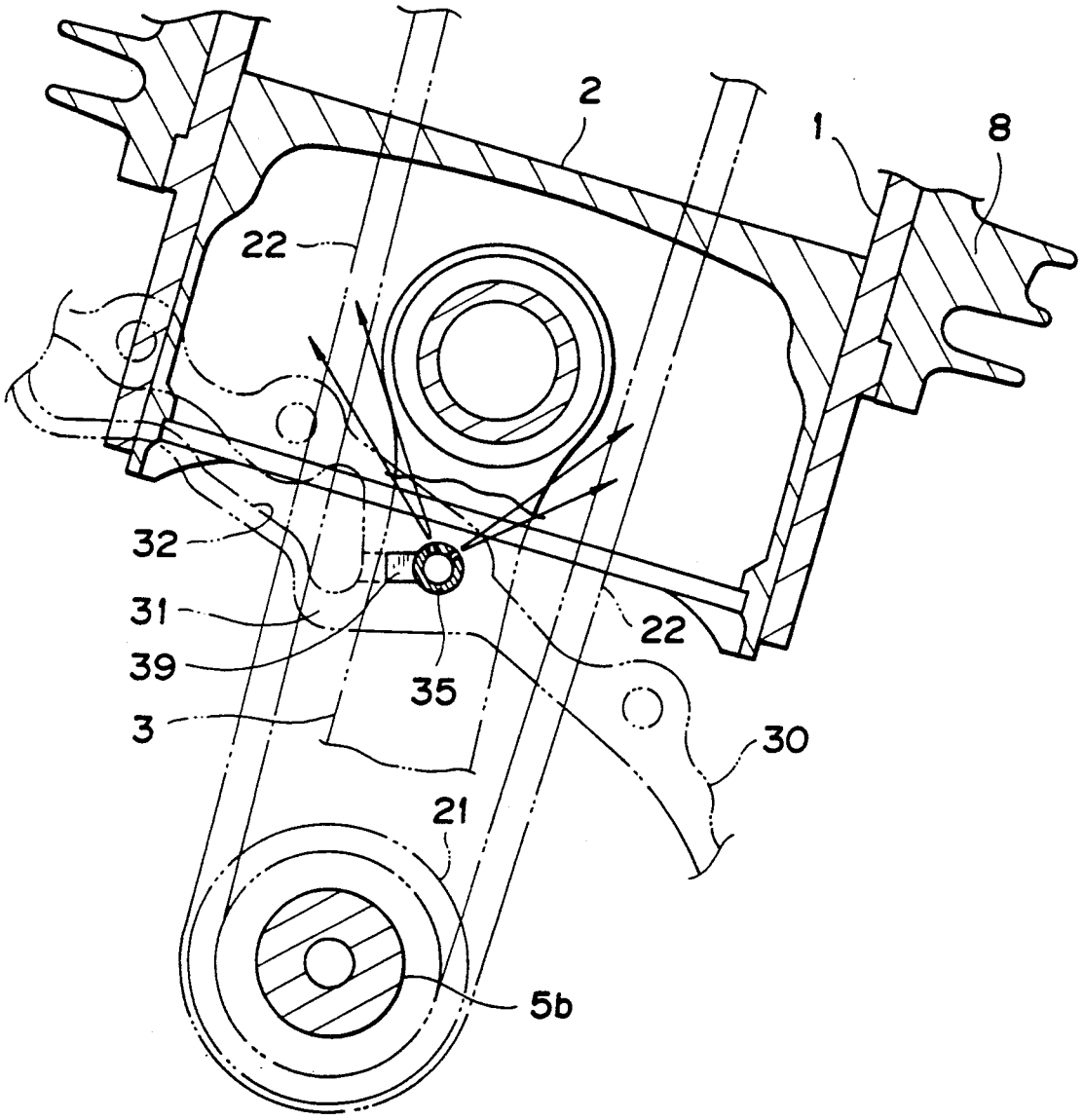
FIG. 4 is an enlarged sectional view taken normal to the sectional view shown in FIG. 3 and within a plane including the oil jetting holes of the oil passage tube.
Figure 5:
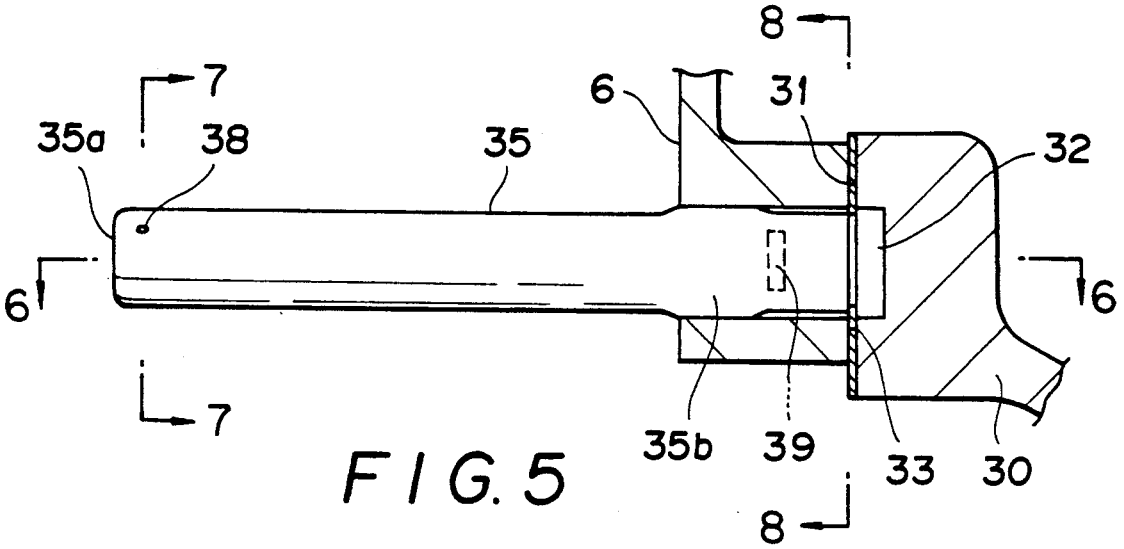
FIG. 5 is a front view of the oil passage tube on an enlarged scale shown in FIG. 1.
Figure 6:
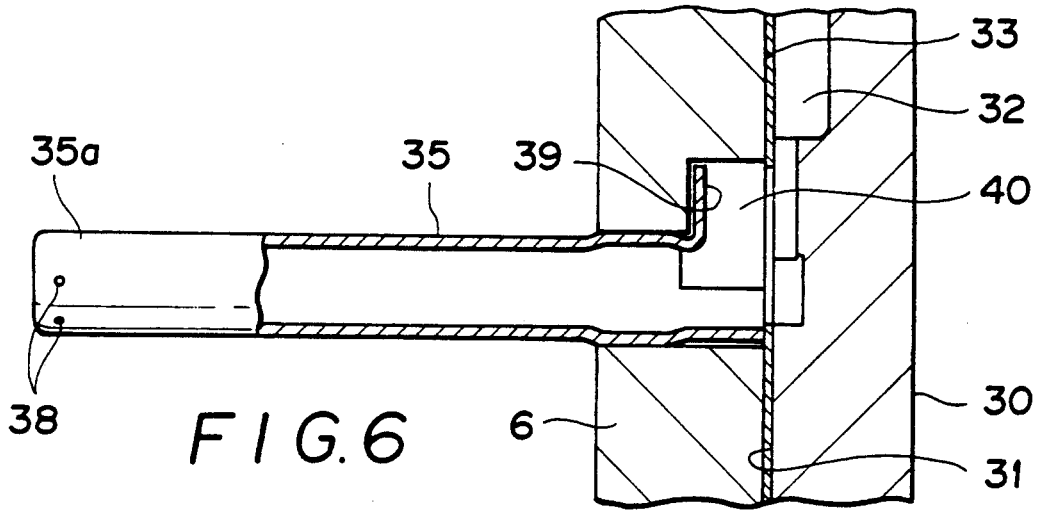
FIGS. 6, 7 and 8 are sectional views taken along the lines 6—6, 7—7 and 8—8 shown in FIG. 5.
Figure 7:
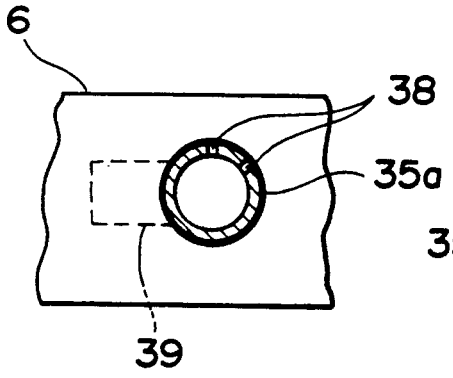
Figure 8:
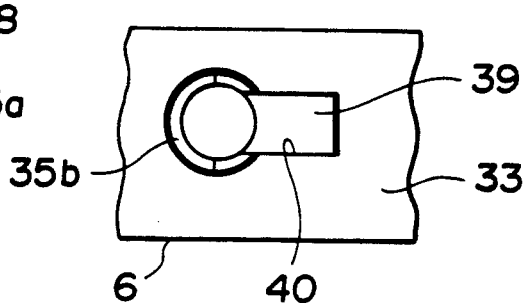

As shown in FIGS. 3 and 4, a recessed groove 32 is formed within a mating face 31 of the clutch cover 30 to be mated with the crank case 6 and the groove 32 constitutes a passageway when the crank case 6 is mated with the clutch cover 30 so that oil fed from an oil pan disposed at the bottom portion of the crank case by means of the operation of an oil pump is guided within the recessed groove 32 formed as a part of the oil passage.

The crank case 6 is also provided with a mating face 33 to be mated with the clutch cover 30 and, at the mating face 33, an oil passage tube 35 is inserted into a through hole 34 disposed parallel to the crank shaft 5b at a position above the cam drive sprocket gear 21.

The oil passage tube 35 extends through the inner space of the annular loop arrangement of the cam chain 22 disposed within the vertical plane, as viewed, between the cam drive sprocket gear 21 and the cam driven sprocket gear 20 and further extends so as to penetrate the side wall 7*b* of the crank case so that the front end of the oil passage tube 35 extends outwardly into a gap 37 defined by means of the side surface of the outer peripheral portion of a crank web 36 disposed within a lower opened portion of the cylinder 1 directly below the lower edge of the piston 2 which is illustrated in the lower dead position.

Referring to FIGS. 5, 6, 7 and 8, the oil passage tube 35 has a front end 35*a* at which one or more oil jetting holes 38 are formed and the rear end 35*b* of the tube 35 is open. The rear end 35*b* has a portion bent outwardly normal to the longitudinal axis of the tube 35 so as to serve as an engaging piece 39 to be engaged with the crank case 6. As described above, when the oil passage tube 35 is inserted into the crank case 6, the engaging piece 39 is fitted within an engaging groove 40 formed within the mating face 33 of the crank case 6 so that the engaging piece 39, that is, the oil passage tube 35, is positioned and fixed with respect to any rotation thereof about the longitudinal axis thereof and the oil jetting hole 38 therefore always faces the lower surface of the piston 2 through means of the gap 37. The end face of the rear end 35*b* of the oil passage tube 35 is in registration with the mating face 33 so as to communicate with the recessed groove 32.

According to the structure described above, even when the cam chain chamber 23 is defined between the clutch cover 30 and the crank case 6, the oil passage tube 35 is led to a position directly below the lower dead position of the piston 2 from the clutch cover 30 through the cam chain chamber 23 and the cooling oil can be supplied and jetted towards the lower surface of the piston 2 through means of the oil jetting hole 38. Accordingly, the location of an oil passage within the thickened portion of the side wall 7*b* of the crank case 6 can be eliminated, and the oil is fed to the upper portion of the side wall 7*b* of the crank case by way of an oil passage formed within the mating faces defined between the crank case 6 and the clutch cover 30, whereby the workability of the lubricating apparatus itself can be remarkably improved with reduced manufacturing cost. In addition, the oil passage tube can be easily removed from the lubricating apparatus by removing the clutch cover 30, thus easily performing any maintenance thereof.

It is to be understood that this invention is not limited to the described preferred embodiment and many other modifications and changes may be made without departing from the scope of the appended claims. For example in one modification, the arrangement of the oil passage tube may be arranged upon a side cover such as upon a magnet cover side except for the clutch cover side in the manner substantially identical to that described hereinbefore. It is therefore understood that within the scope of the appended claims, the present invention can be practiced otherwise than as specifically described herein.

What is claimed is:

1. A lubricating system for an internal combustion engine, within which there is provided a crank case, a crank shaft disposed within said crank case and having one end thereof extending outwardly from a side wall of said crank case, a cover mating with said side wall of said crank case so as to cover said one end of said crank shaft, a cam drive sprocket gear mounted upon said crank shaft, a cam driven sprocket gear mounted upon a cylinder head of a cylinder block within which a cylinder is defined for reciprocatably housing a piston of said engine, a cam chain chamber defined within said cylinder block for housing a looped chain interconnecting said cam drive sprocket gear and said cam drivn sprocket gear, the improvement comprising:

a support passage defined within a first portion of said side wall of said carnk case disposed upon one side of said cam chain chamber;

an oil passage defined within a second portion of said side wall of said crank case which mates with said cover and which is disposed upon a second side of said cam chain chamber; and an oil passage tube means, having a first open end thereof disposed within said oil passage for receiving a supply of oil thereform, and a second end thereof disposed within said support passage and having at least oen oil jetting hole defined therein, passing through said cam chain chamber such that said second end of said oil passage tube means has said at least oen oil jetting hole oriented outwardly from said support passage and toward an interior portion of said cylinder so as to spray oil toward a lower surface portion of said piston when said piston is disposed within the vicinity of a lower dead position within said cylinder.

2. A lubricating apparatus according to claim 1, wherein:

said oil passage tube means is provided at said first end with a portion bent outwardly normal to a longitudinal axis of said oil passage tube means and said second portion o said side wall of said crank case is provided with an engaging groove which is engaged by said bent portion of said oil passage tube means so as to retain said oil passage tube means within said second portion of said side wall of said crank case.

3. A lubricating system for an internal combustion engine, within which there is provided a crank case, a crank shaft disposed within said crank case and having one end thereof extending outwardly from a side wall of said crank case, a cover mating with said side wall of said crank case so as to cover said one end of said crank shaft, and a cylinder block within which a cylinder is defined for reciprocatably housing a piston of said engine, the improvement comprising:

a support passage defined within a first portion of said side wall of said crank case;

an oil passage defined within a second portion of said side wall fo said crank case which mates with said cover; and an oil passage tube means, having a first open edn thereof disposed within said oil passage for receiving a supply of oil therefrom, and a second end thereof disposed within said support passage and having at least one oil jetting hole defined therein, said second end of said oil passage tube means having said at least one oil jetting hole oriented outwardly from said support passage and toward an interior portion of said cylinder so as to spray oil toward a lower surface portion of said piston when said piston is disposed within the vicinity of a lower dead position within said cylinder.

4. Lubricating apparatus as set forth in claim 3, wherein:

said oil passage tube means is provided at said first end with a portion bent outwardly normal to a longitudinal axis of said oil passage tube means; and said second portion of said side wall of said crank case is provided with an engaging groove which is engaged by said bent portion of said oil passage tube means so as to retain said oil passage tube means within said second portion of said side wall of said crank case.

5. Lubricating apparatus as set forth in claim 1, wherein:

said internal combustion engine is mounted upon a motorcycle.

6. Lubricating apparatus as set forth in claim 1, wherein:

said internal combustion engine is an overhead cam type four-cylinder engine.

7. Lubricating apparatus as set forth in claim 1, wherein:

said internal combustion engine is mounted upon a motorcycle.

8. Lubricating apparatus as set forth in claim 1, wherein:

said internal combustion engine is an overhead cam type four-cylinder engine.

9. Lubricating apparatus as set forth in claim 3, further comprising:

intake and exhaust valves operatively mounted within a cylinder head of said cylinder block;

a cam shaft rotatably mounted upon said cylinder head and comprising a plurality of cams for controlling said intake and exhaust valves;

a cam drive sprocket gear mounted upon said crank shaft;

a cam driven sprocket gear mounted upon said cam shaft;

a cam chain chamber defined within said cylinder block between said first and second side wall portions of said crank case; and a cam chain, defining an endless loop, interconnecting said cam drive sprocket gear and said cam driven sprocket gear and disposed within said cam chain chamber, said oil passage tube means extending through said cam chain chamber, between said first and second side wall portions of said crank case, so as to extend through said endless loop of said cam chain between longitudinally extending side portions of said endless loop of said cam chain.

* * * * *